US005246258A

United States Patent [19]

Kerschenbaum et al.

[11] Patent Number: 5,246,258

[45] Date of Patent: Sep. 21, 1993

[54] RIM TYPE DOOR LOCK WITH INTERCHANGEABLE BOLT ASSEMBLIES AND ADJUSTABLE BACKSET PLATE ASSEMBLIES

[76] Inventors: Sidney Kerschenbaum; Barry Kerschenbaum, both of 135-60 233rd St., Rosedale, N.Y. 11422

[21] Appl. No.: 792,703

[22] Filed: Nov. 15, 1991

Related U.S. Application Data

[63] Continuation-in-part of Ser. No. 277,237, Nov. 29, 1988, abandoned.

[51] Int. Cl.[5] ..... E05B 47/02

[52] U.S. Cl. ..... 292/144; 70/279; 70/280; 70/281; 292/244

[58] Field of Search ..... 70/277, 279-282, 70/461; 292/144, 244

[56] References Cited

U.S. PATENT DOCUMENTS

| | | | |
|---|---|---|---|
| 2,516,991 | 8/1950 | Heyer | 292/244 |
| 2,672,943 | 3/1954 | Chatlynne et al. | 292/144 X |
| 2,786,701 | 3/1957 | Povlich | 292/144 |
| 3,636,745 | 1/1972 | Green | 292/144 X |
| 3,947,060 | 3/1976 | Zimmer et al. | 292/144 X |
| 3,989,286 | 11/1976 | Cleff | 292/144 X |
| 4,800,741 | 1/1989 | Kerschenbaum et al. | 292/144 X |
| 4,866,961 | 9/1989 | Yang | 70/277 X |
| 5,044,678 | 9/1991 | Detweiler | 292/144 |

FOREIGN PATENT DOCUMENTS

| | | | |
|---|---|---|---|
| 103785 | 7/1926 | Austria | 292/177 |
| 187328 | 6/1907 | Fed. Rep. of Germany | 292/144 |
| 2504774 | 8/1975 | Fed. Rep. of Germany | 292/144 |
| 559461 | 6/1923 | France | 292/144 |
| 2533612 | 3/1984 | France | 292/144 |
| 109233 | 8/1966 | Norway | 70/277 |

*Primary Examiner*—Lloyd A. Gall
*Attorney, Agent, or Firm*—Galgano & Belkin

[57] ABSTRACT

A rim lock having a housing within which is disposed a solenoid with anvil and a plunger movable within the solenoid being reversible and interchangeable within the housing and using interchangeable bolt assemblies to provide for Fail Safe or Fail Secure or Mechanical applications. This invention also accommodates in a compact manner the use of the rim lock for both inswing and outswing door applications and from narrow to large stile door configurations.

17 Claims, 6 Drawing Sheets 10
12
16
18
20
22
24
26
28
32
36
38
40
42
44
46
48
50
52
54
56
58
59
59a
60
62
62a
64
66
68
70
72
80
81
82
83
84
85
85b
125
125a
125b
128
131a
144
144a
144b
2
2a
2b
2c
3
3a
4
4a
4b
5
6
12
212
212a
212b
212c
"A"
A'

10'
98d
98b
98
98c
101
101a
140
133b
133a
133
131h
86a
86b
A'
144a
131
104
140a
144
86
132a
132
86c
100z
100a
92
90
211z
211
106a
211a
106
100
94
96
87
66b
113
119
125b
125a
125
"A"
114
116
80b
112
118
67
67a
110
28b
108
59b
19
18
26
22
3
4
20
15
2a
83
102
144b
84
85
82
128
4a
214c
214k
5
214b
3a
12
85b
4b
81
2
2b
5b
5d
50b
5f
5e
126a
126b
126

102s
102s
102m
102k
90k
94k
102P
106m 101
213
213m
101a
98
133b
133k
140
960
960a
86a
133a
131h
140a
86b
961
961a
963a
A'
131h
140k
963
144a
962a
131k
131h
962
104
86k
66b
113
119
86k
86c
132
132a
"A"
102m
106m
90k
67
28b
100z
100
102k
100a
80b
94k
83
2a
85
59b
24P
18P
19P
20P
5b
5d
3P
128
5f
50b
214c
4P
81
214b
5
214k
5e
12
126a
2a
82
126b
2c
3a
4b
126
"A"
2
2b
2b
213p

RIM TYPE DOOR LOCK WITH INTERCHANGEABLE BOLT ASSEMBLIES AND ADJUSTABLE BACKSET PLATE ASSEMBLIES

CROSS REFERENCE TO RELATED APPLICATION

This application is a continuation-in-part of copending application Ser. No. 277,237 filed Nov. 29, 1988, now abandoned.

BACKGROUND OF THE INVENTION

1. Field of the Invention

The present invention relates to an electrically and or manually operable door lock.

More particularly, the present invention relates to a rim lock of the type used on the inside surface of a door or the like where individuals can be buzzed in and/or out by a shopkeeper or receptionist; and where mechanical actuation of the lock is also possible from inside the door or from where it may be desired.

2. Description of the Prior Art

A remotely actuated door lock can be strike-centered, that is, have its actuating mechanism in the strike on the doorjamb or in the lock on the door.

Such a strike-centered lock has the disadvantage of being fairly difficult to retrofit on the door with the bulky strike mechanism, and also such systems are normally easy to jimmy and otherwise circumvent.

There are many types of door-mounted locks. They may be incorporated in the doorknob assembly, as in U.S. Pat. No. 4,073,527 to Schlage.

In another such arrangement as disclosed in U.S. Pat. No. 2,763,888 to Billeter, a pneumatic door-mounted door closer is connected to a pneumatic actuator in a lock mechanism to withdraw the bolt momentarily as the door is just about closed, so that the door bolt does not noisily engage the strike.

In U.S. Pat. No. 3,234,766 to O'Brian a small rotary output motor carries a worm on its output shaft that meshes with a gear-sector paul that operates the latch bolt. It is not structured to include backset choices, a crosspiece fin, a plunger which is practically a one piece assembly and is held rigidly together directly in one axis line for greater efficiency and durability.

Similarly U.S. Pat. Nos. 3,576,119 and 3,751,086 to Harris and Geringer, respectively, have a solenoid mounted directly on the door.

In U.S. Pat. No. 3,890,608 to Peterson the solenoid is linked to the bolt.

A system kinematically identical to that of Peterson is seen in U.S. Pat. No. 4,169,616 also to Peterson which uses a pneumatic actuator.

All such arrangements are fairly bulky, making it impossible to mount them on the inside surface of the thin (narrow) stile of a standard metal-and-glass entrance door of the type used in shops and offices, etc., in such a manner that it can be actuated from outside the door by a standard rim key cylinder.

A partial solution to this problem of retrofitting an existing (narrow) thin-stile door is proposed in U.S. Pat. No. 4,099,752 to Geringer. However, the mechanism of this patent is extremely complex.

With all these arrangements manual actuation of the lock is frequently impossible, and it is often also impossible to cut out the lock by holding it in a position with its bolt fully retracted. What is more, such locks are normally only set up for one particular type of installation, for instance, an in-swinging door; that cannot be adapted at the site to different setups.

The Savarieau et al. and Bright references basically are to latch or fasten the door in a locked position rather than as an alternate to keep a door unlocked, without the use of the bolt, crosspiece fin, and plunger assembly structure.

Curtiss et al. and Flodell's strikes do not use one part of the assembly for outswing doors and another part of the assembly for inswing doors, etc.

Rifkin, Hamilton, Cleff, Rau, Spinello, Ewing, Pond, and Nikolaus have their relative differences too.

O'Brien's 82 is a threaded member which engages mounting plate 28 and rear housing plate 16, the latter being locked in place by a key 84. It appears that 86 is a shaft on the other side connected to handle 90 and cam 88.

O'Brien's invention is mainly a motor driven unit with an added solenoid and with mechanical apparatus of a different character and different objectives than that of the present invention including backset choices, bolt, crosspiece fin, and plunger assembly structure, etc.

3. Description of the Prior Art: (Continued)

Povlich U.S. Pat. No. 2,786,701 shows a lock for an automobile door. Its bolt shaft does not movably extend through both the throughbores of an anvil and a plunger, nor is it so movably mounted. It needs a second solenoid to keep it in locked position. Its switch is to control a light. It and its housing do not accommodate interchangeable and reversible parts, and reversible parts and it do not mount on from narrow to large stile doors, or slam lock on inswinging and or outswinging doors, with solenoid power on.

In the French reference 559,461, the bolt head or bolt 18 here, which is actually diametrically tapered, enters and lies within the core member 4, and within its solenoid 5. It does not have a bolt shaft running through both of its core members 6 and 4 and one of them is solid. The removable means 8 here is with a thread in a deeply enclosed area of its mechanism requiring a lenthly operation to accomplish its means, not a quick and simple means of just removing a clip at the end of a shaft easily accessible. It is not mountable on narrow to large stile doors, and the strike 28 has multiple moving parts and does have an independent single function.

The four sided box of the Austrian reference 103,785 has no facilities for interchangeable parts or for reversing parts and is not facilitated to be mounted on narrow to large stile doors.

The Heyer U.S. Pat. No. 2,516,991 teaching shows a means, where its bolt head 32 is retracted to line-up with its screw 31, and with its hole 35, so that the screw 31 can be reached there, and so loosened and then the bolt head 32 can then be turned 180°. And so by doing this, the lock here would not have to be taken apart, to accomplish its means. The bolt here does not have a shaft running through both an anvil and a plunger for a compact electronic service, with a clip at the end of said shaft being a means for receiving a bolt assembly.

Another principal disadvantage of such locks is that they must be made in many totally different models to accommodate different features, depending on security requirements.

BRIEF DESCRIPTION OF THE DRAWING

FIG. 21 is a perspective view of the housing receiving a cosmetic closure plate.

SUMMARY OF THE INVENTION

Figures 1, 2:
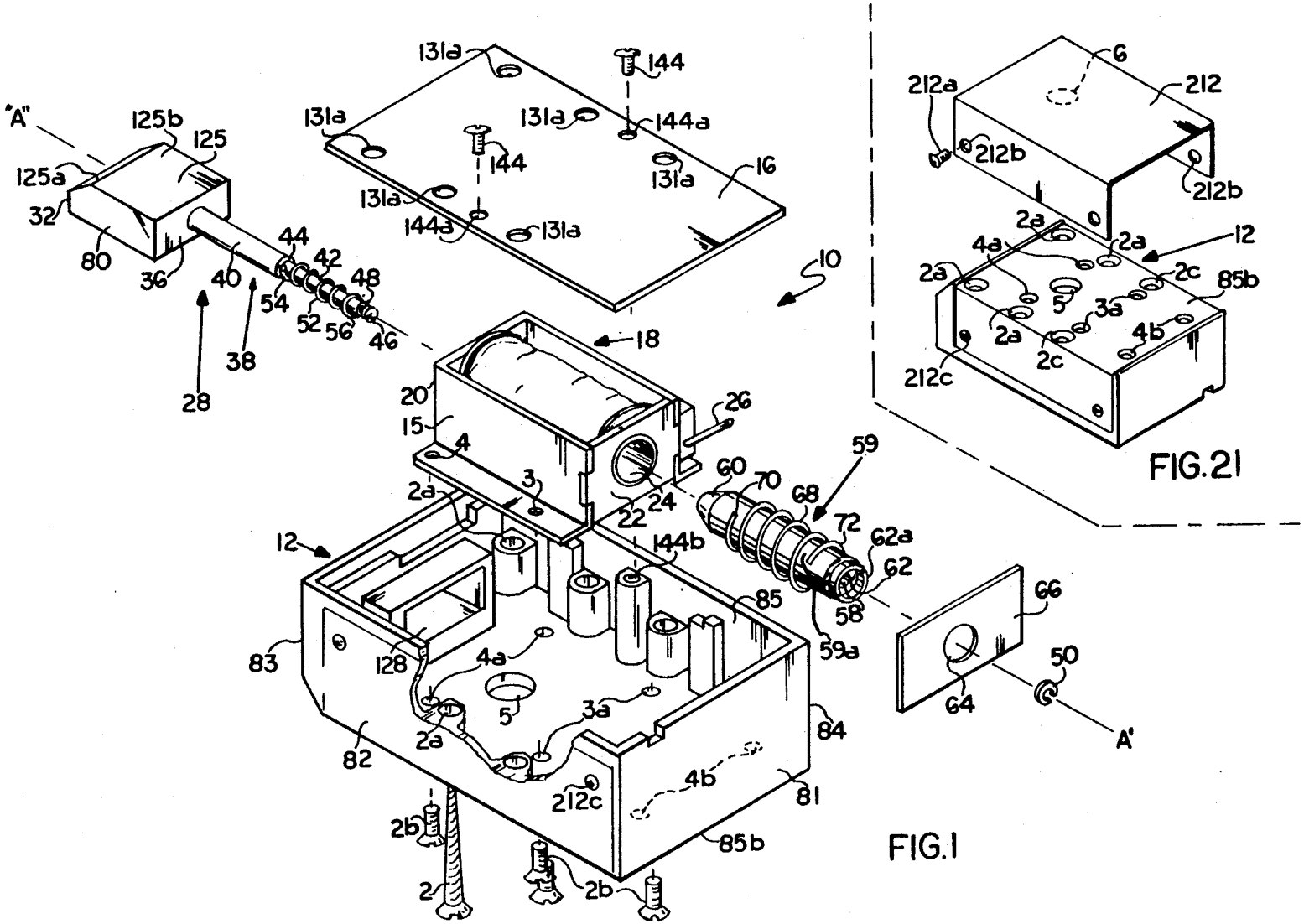
FIG. 1 is an exploded perspective view of the improved lock of the present invention.
FIG. 2 is a plan view, showing the internal parts of the improved lock of the present invention when the improved lock is in the unlocked position with the electric current off.

Accordingly, it is an object of the present invention to provide an improved lock which avoids the disadvantages of the prior art.

More particularly, it is an object of the present invention to provide an interchangeable Fail-Secure and Fail-Safe electric and mechanical lock that freely locks the door when the door is slammed shut, and is not jimmyable by a plastic card, and includes interchangeable and reversible bolt assemblies for in and/or out swinging doors and also adapts to, from narrow stile to large stile door installations.

In keeping with these objects, and with others which will become apparent hereinafter, one feature of the present invention resides, briefly stated, in a lock which comprises a special housing that accommodates interchangeable component parts and component parts in different positions, a solenoid that is disposed within the housing, an interchangeable plunger movably mounted within the solenoid, a first bolt assembly having a bolt and its shaft being removably mounted within an interchangeable plunger and with a crosspiece, a second bolt assembly being interchangeable with the first bolt assembly and having a bolt, a removably mounted crosspiece, and a plunger and the plunger being removably mounted within the solenoid, and means for removably mounting the second bolt assembly and the plunger from within the solenoid, and lock having means for removably mounting the first bolt assembly and its shaft part from within the associated plunger and solenoid, a clip is provided.

Besides having a manufacturing and a mounting instructions cost effective advantage, said lock having its interchangeable feature, also has an advantage when a customer wishes to change a Fail-Safe installation for an adjustable backset Fail-Secure or total mechanical installation or visa versa, as the surface mounting installation in all the cases here are identical and the same strikes are used.

When the improved lock is designed in accordance with the present invention, the bolt assemblies can be rotated to fit inswing and outswing door applications.

In accordance with another feature of the present invention, the removably mounting means include a removably mounted crosspiece.

Yet another feature of the present invention is that the housing can accommodate interchangeable component and reversible parts and narrow to large stile door installations and another feature of the present invention are the adjustable backset plate assemblies to accommodate a key cylinder on a door at various different backset settings.

Still another feature of the present invention is that it further comprises an electrical lever switch so that the current supplied to the solenoid is decreased in an effort to keep the solenoid cool during continuous use.

Yet still another feature of the present invention is that the bolt is made from nonmagnetic material.

Still yet another feature of the present invention is that the Fail-Safe bolt assembly has a shaft with a free end that contains a groove for a clip.

Another feature of the present invention is that the shaft has a wide portion, and a narrow portion, the narrow portion has a first spring disposed thereon.

Yet another feature of the present invention is that the plunger has a second spring disposed thereon and a central throughbore.

Still another feature of the present invention is that it further comprises an anvil with a central throughbore disposed within the solenoid.

Yet still another feature of the present invention is that the anvil and the plunger are made from magnetic material, for electronic use.

Still yet another feature of the present invention is that the anvil and the plunger have complementary surfaces that are in magnetic contact, for electronic use.

Another feature of the present invention is that it further comprises a clip removably mounted on the groove of the shaft of the Fail-Safe bolt assembly.

Yet another feature of the present invention is that the bolt assemblies are interchangeable and each having a plunger removably mounted within the solenoid, the bolts each of which having a ramped and flat surface engaged in a strike so that when each or either of the bolts, or bolt assemblies cannot be forced back by a plastic card or the like.

In keeping with these objects, and with others which will become apparent hereinafter, one feature of the present invention resides, briefly stated, in a lock which comprises a housing, a solenoid disposed within the housing, a plunger movably mounted within the solenoid, a bolt assembly having a bolt and shaft and being removably mounted with the plunger and lock wherein a compact means for retracting the bolt assembly, while the lock is electronically in the locked position, is provided.

When the improved lock is designed in accordance with the present invention, when the door slams closed, the bolt and its assembly will initially retract as it encounters the strike and then subsequently the bolt part will extend into the strike.

Another feature of the present invention is that it further comprises a bridge being disposed internally to the housing and having a rack gear, a main portion, a gear portion, and a track portion.

Yet another feature of the present invention is that it further comprises a clamp plate having a central throughbore, pin holes, and a track protrusion, to accommodate the removably mounted crosspiece.

Yet still another feature of the present invention is that the bolt has pin protrusions which mate with the holes of the clamp plate.

Still another feature of the present invention is that the bridge has a substantially "L"-shaped cross-section, and an alternate with a headpin feature.

Still yet another feature of the present invention is that it further comprises a crosspiece containing a cutout and protrusions.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawings.

DETAILED DESCRIPTION OF THE PREFERRED EMBODIMENTS

Referring now to FIGS. 1–7, the improved lock of the present invention is shown generally at 10. The improved lock 10 includes a housing 12 which is substantially a four sided open multi feature box with sides 81, 82, 83, 84 and an open side 85 with side 83 having a bolt opening 128 which accommodates interchangeable component parts and reversible parts and can be mounted on various different, from narrow stile to larger stile doors, with a removeable cover plate 16.

Plate 16 is used to cover opening 85 of housing 12 to be attached thereto with screws (not shown) utilizing the clearance holes **144*a* in cover plate 16 and threaded holes 144*b* of housing 12. Lining up clearance holes 131*a* of plate 16 with clearance holes 2*a* of housing 12 with screws (not shown) are used to mount lock 10, when assembled, on door or door stile inside surface 109*c***.

Internal to the housing 12 is located a solenoid assembly 18 having an anvil side 20 facing bolt opening 128, a plunge in side 22, and a solenoid coil core hole 24, containing an anvil 73, made of magnetic material affixed at side 20. The solenoid assembly 18 contains an electrical lever switch 26.

Extending into the solenoid coil core hole 24 from the plunge in side 22, is the first plunger assembly 59 containing the center shoulder hole 58 which is part of central throughbore **58*a*** therein.

The first plunger assembly 59 has a front end 60 which is substantially frustum shaped and a rear end 62 and is rigidly affixed within the central throughbore or hole 64 in crosspiece 66. A spring 68 having a front end 70 and a rear end 72 freely fits on the first plunger assembly 59.

The front end 70 of the spring 68 abuts against the outer plunge side 22 of the solenoid assembly 18 and the rear end 72 of the spring 68 abuts against the affixed crosspiece 66 and by doing so, urges the plunger assembly 59 outward of the coil core 24.

Seen in FIGS. 1 through 4, plunger **59*a*, made of magnetic material is moveably mounted within the core 24 of solenoid 18 with spring 70 and affixed crosspiece 66** made of nonmagnetic material attached.

FIG. 1 shows solenoid assembly 18 by utilizing its threaded mounting holes 3 and 4 is lined up with holes **3*a* and 4*a* inside of main housing 12 closer to bolt opening 128 and is, there attached with fasteners or screws 2*b* in position as shown in FIGS. 2, 3, and 4, and 8,** here for Fail-Safe operation.

The anvil 73 fits snugly in the coil core 24 and the first plunger **59*a* of first plunger assembly 59 runs freely back and forth along axis A' in the coil core 24**.

Figure 3:
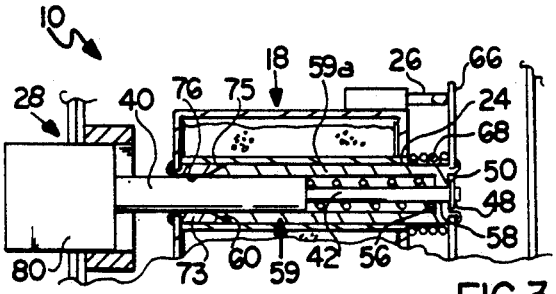
FIG. 3 is a plan view, showing the internal parts of the improved lock of the present invention when the improved lock is in the locked position with the bolt extended.
Figure 4:
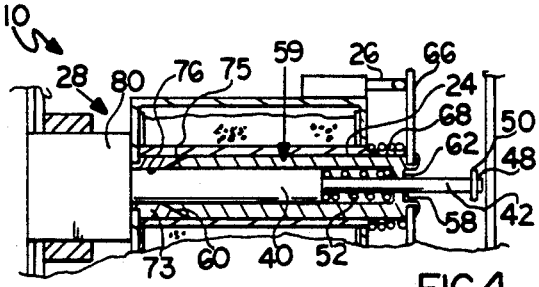
FIG. 4 is a plan view, showing the internal parts of the improved lock of the present invention when the improved lock is in the unlocked position with the bolt assembly in the housing.

Referring now to FIGS. 2 through 4, an anvil 73 with a rear side 75 is rigidly affixed internally to the solenoid assembly 18 and contains a throughbore 76. The rear side 75 of the anvil 73 is so formed so as to complementary receive the frustrum shaped front end 60 of the plunger assembly 59 where the wide shaft section 40 of the bolt assembly 28 runs freely in the throughbore 76 of the anvil 73 and the narrow shaft section 42 runs through the center shoulder hole 58 which is part of throughbore **58*a* running through the entire center axis of the first plunger assembly 59** of axis A' running between locked and open positions.

The bolt assembly 28 has a bolt 80 with a front side 32 having a beveled ramp **125*a* and a rear side 36. Extending from the rear side 36 of the bolt 80 is a bolt shaft 38. The bolt shaft 38 includes a wide section 40 and a narrow section 42 which is colinear with the wide section 40. A shoulder 44 is formed where the wide section 40 meets the narrow section 42**.

The narrow section 42 has a free end 46 with a circumferenced groove 48 for receiving a clip 50. A spring 52 having a front end 54 and a rear end 56 is located on the narrow section 42 so that the narrow section 42 fits freely through the spring 52. The front end 54 of the spring 52 abuts against the shoulder 44 because the diameter of the spring 52 is substantially equal to that of the wide section 40. The rear end 56 of the spring 52 abuts against the inner center shoulder area of hole 58 urging the bolt assembly 28 forward.

Figure 8:
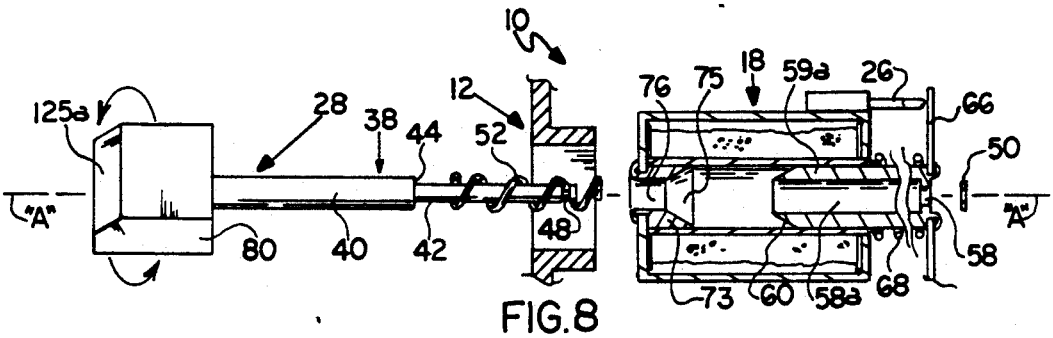
FIG. 8 is an exploded plan view showing how, if necessary, the bolt assembly is reversed.

The narrow section 42 of the bolt assembly 28, as seen in FIG. 8, slides through the center throughbore 58*a* and shoulder hole 58 of the rear end 62 of the plunger assembly 59.

The clip 50 is insertable into the circumferenced groove 48.

The interchangeable first bolt assembly 28 all made of non-magnetic material, enters housing 12 through bolt guide opening 128. The first bolt assembly shaft areas 40 and 42 shown in FIGS. 2, 3, 4 and 8 run through and within the anvil throughbore 76 and also through the plunger throughbore hole 58 and 58*a*, and with circumference groove 48 of shaft area 42 extending out of rear end 62 of plunger assembly 59. As seen in FIGS. 3 and 4, first bolt assembly 28 is movable between locked and open positions, for Fail-Safe latching.

In operation, this Fail-Safe assembly of the improved lock 10 of the present invention is shown, in FIG. 2, in the unlocked or open position, when the electric current is off, solenoid not energized.

When current is turned on energizing the solenoid as shown in FIG. 3, the anvil 73 magnetically pulls the plunger assembly 59 displacing the crosspiece 66 so that the crosspiece 66 pushes the electrical lever switch 26. By activating the electrical lever switch 26, the current supplied to the solenoid assembly 18 is decreased so that the solenoid assembly 18 will remain cool while it is in continuous use magnetically holding the plunger assembly 59 in contact with the anvil 73 which holds the improved lock 10 in the locked position with the bolt assembly 28 extended as seen in FIG. 3.

Figure 5:
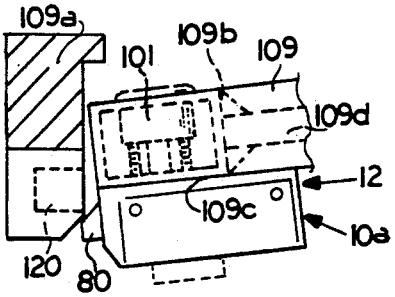
FIG. 5 is a plan view in partial cutaway showing the bolt in relationship to the strike when the bolt is in the relative position of FIG. 4, with lock mounted on a narrow stile door (in dotted lines)
Figure 2:
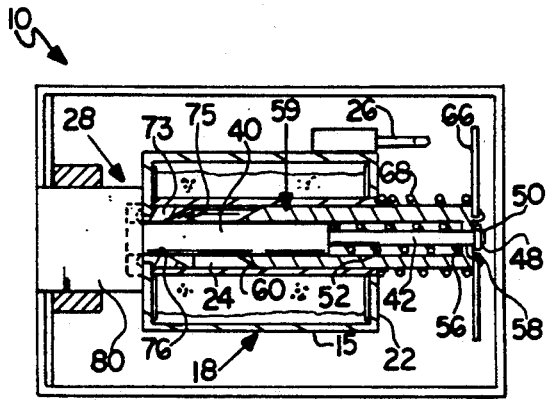

As shown in FIG. 3, the improved lock 10 is electronically in locked position. As the solenoid assembly 18 is energized, as current is on, and the plunger assembly 59 is holding the anvil 73 in magnetic contact. However, the bolt assembly 28 is still able to retract as seen in FIG. 4, as the spring 52 compresses and the bolt shaft sections 40 and 42 passes or slides through both the center throughbore 73 of anvil 76 and the center throughbore 58*a* and 58 of plunger 59*a* here of solenoid 18, as shown in FIG. 5. As the bolt 80 of assembly 28 proceeds latching into strike 120 and compresses the spring 52 so that as the in-swing door 109 is closing, the bolt 80 can enter the associated strike cavity 120.

Figure 7:
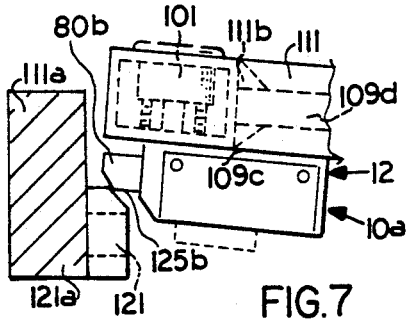
FIG. 7 is a plan view in partial cutaway showing the bolt in relationship to the strike when the bolt assembly is reversed compared to bolt in FIG. 6, with lock installed on a narrow stile door (in dotted lines)

FIGS. 5 and 7, also shows the narrow stile door 111*b* and 109*b* (dotted lines) with the larger stile door 111 and 109, having mounted thereon a Fail-Secure and all mechanical lock 10*a* having a key cylinder 101 instead of the Fail-Safe lock 10 described above. Either type door can be accommodated by either interchangeable Fail-Safe lock 10 or the Fail-Secure and all mechanical lock 10*a*.

Figure 6:
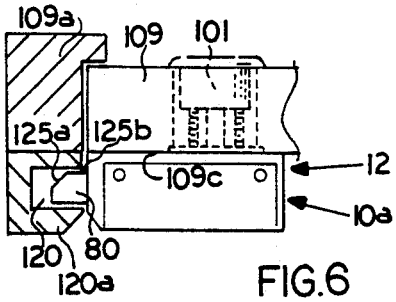
FIG. 6 is a plan view in partial cutaway showing the bolt in relationship to the strike when the bolt is in the position of FIG. 3, with lock mounted on a large stile door (rim)

FIG. 6 also shows lock 10*a* mounted on door 109. The bolt 80 or 80*b* is entered into strike cavity 120 of strike 120*a* mounted on the door frame 109*a* bringing lock 10*a* into the locked position.

Seen in FIGS. 1, 9, 21 and 22, the housing 12 has six mounting holes for mounting the lock on doors, with screws 2. The four front holes 2*a* on the housing 12, two on each side, are used for narrow stile installation. All six holes 2*a*, and 2*c* can be used on wider stile doors. This arrangement is applicable to both Fail-Safe and Fail-Secure locks 10 and 10*a*.

FIG. 8 shows the clip 50 removed from the groove 48 of the narrow section 42. The bolt assembly 28 is pulled forward out of the lock 10, for the purpose of turning the bolt assembly 28, 180° on its axis "A", reversing its bevel ramp 125*a* for use in either inswinging doors 109*b* or outswinging doors 111 or 111*b* with the associated strikes 120 and 121 on door frames 109*a* and 111*a* respectively.

Referring now to FIGS. 9 to 18 where an alternate embodiment of the improved lock is shown generally at 10'. The lock 10' includes the housing 12 having a closed top 85*b* and four closed sides 81, 82, 83 and 84 and an open area 85. The adjustable backset plate assembly 86 closes the open area 85 of the housing 12.

Figures 9, 10:
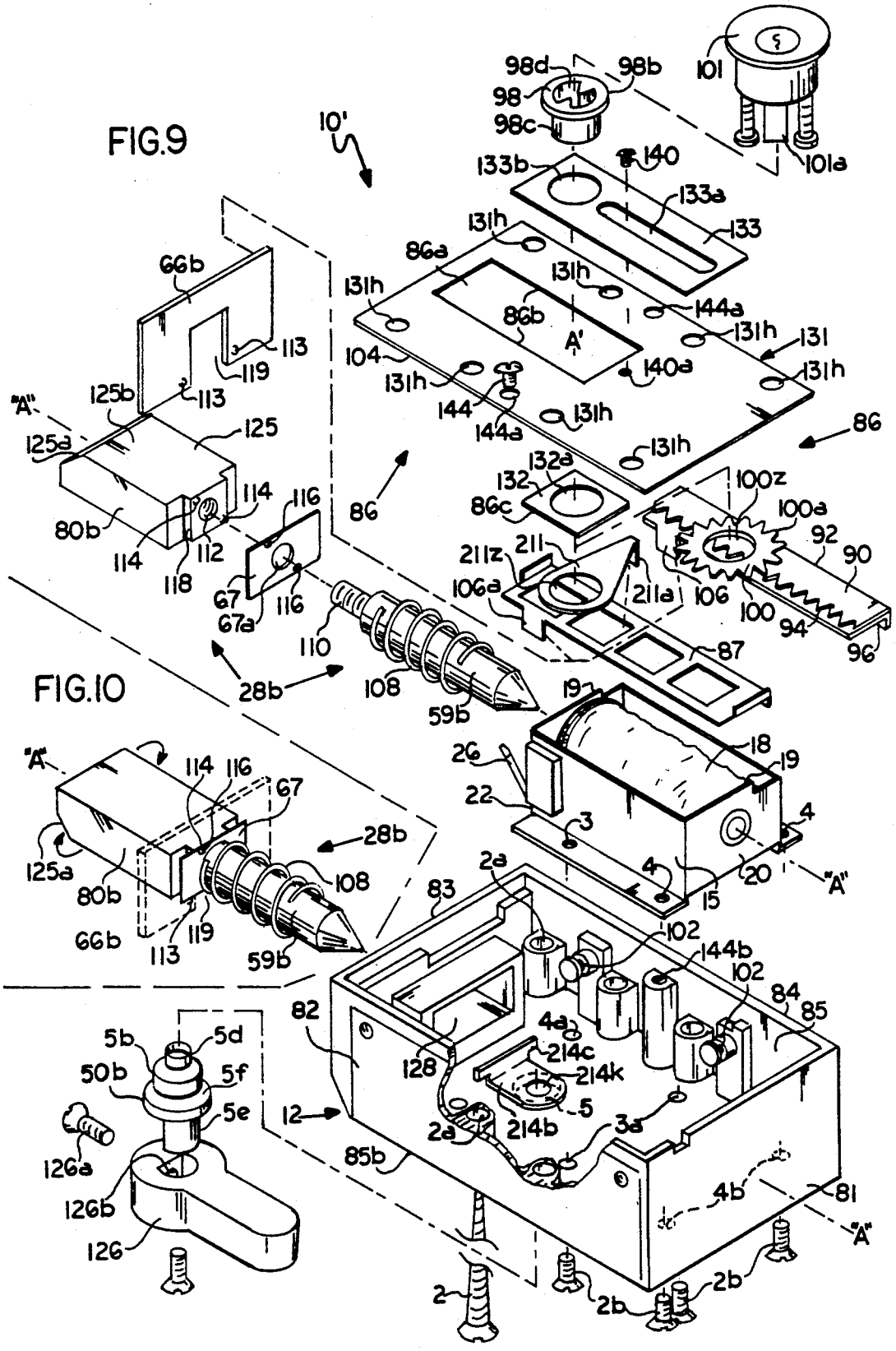
FIG. 9 is an exploded perspective view of an alternate embodiment of the invention shown in FIG. 1.
FIG. 10 is a view showing parts of the alternate embodiment of the invention shown in FIG. 9 assembled.

For Fail-Secure use as seen in FIGS. 9 to 18, the solenoid assembly 18 is set into the main housing 12 with plunge in side 22 facing bolt opening 128, 180° relative to the Fail-Safe setting. For Fail-Secure use, the threaded mounting holes 3 and 4 of the solenoid assembly 18 is lined up with holes 3*a* and 4*b* of the main housing 12 furthest back from bolt opening 128, as seen in FIG. 9. Solenoid assembly is secured with fasteners or screws 2*b* as seen also in FIGS. 11 through 15.

The interchangeable second bolt assembly 28*b*, seen in FIG. 10, but with crosspiece 66*b* unattached, enters the housing 12 through bolt guide opening 128 in FIG. 9. The plunger 59*b* of bolt assembly 28*b* enters from the plunge in side 22 into the core opening 24 of solenoid assembly 18, and the crosspiece 66*b* is attached.

The bolt 80*b*, clamp plate 67, and plunger 59*b* of bolt assembly 28*b* are fixedly attached to each other. The plunger 59*b* has an outer screw thread 110 thereon, and the bolt 80*b* has an inner threaded hole 112 contained therein.

The bolt 80*b* has pin protrusions 114 which mate with holes 116 of the clamp plate 67, while clamp plate throughbore 67*a* lines up with the internal threaded hole 112, and a track protrusion 118.

The crosspiece 66*b* has a cut out 119 which allows the crosspiece 66*b* to slide into place between the bolt 80*b* and the clamp plate 67 along the track protrusion 118 of the bolt 80*b*.

The ball protrusions 113 of the crosspiece 66*b* force their way against the clamp plate 67, which is made from flat springy material, and causes the crosspiece 66*b* to be pushed into place in the bolt assembly 28*b*. The ball protrusions 113, keep the crosspiece 66*b* in place, when the protrusions 113 come out just below the bottom of the clamp plate 67 seen in FIG. 10.

Figure 11:
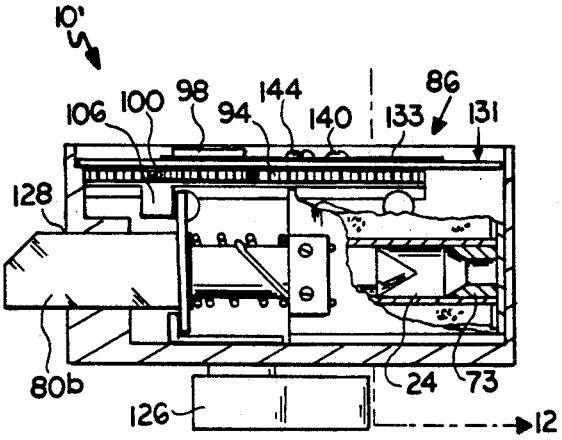
FIG. 11 is a plan view showing the alternate embodiment with the bolt assembly advanced.

Then as seen in FIG. 11, the attached crosspiece 66*b* with the aid of front lever 214*b*, which is also used to bring this lock 10' to open position (see FIG. 13) holds the interchangeable second bolt assembly 28*b* here removably mounted and or movably mounted in lock 10' for Fail-Secure latching.

The thumb-turn knob 126 causes movement from the front of the lock 10' on the inside part of the door 109*c* seen in FIG. 5. Part 5*d* and 5*b* of knob shaft 50*b* enters through hole 5 with shoulder 5*f* bearing on top side 85*b* of housing 12 in FIGS. 1, 9, 12 and 21. Part 5*d* of knob shaft 50*b* is fixably attached in hole 214*k* of lever 214*b*. When cover 212 is in place, part 5*e* of shaft 50*b* is brought into hole 126*b* of knob 126 and fixably fastened together with screw 126*a* in FIG. 9. When knob 126 is manually turned, the lever 214*b* in turn, turns and lever part 214*c* pushes crosspiece 66*b* and bolt assembly 28*b* backward within the lock 10' in FIG. 13, putting the lock in the unlocked position.

The housing 12 has a hole 5 seen in FIG. 21, FIG. 9 and FIG. 1, for the accommodation of the knob 126 seen in FIGS. 9, 12, 13, 14 with the knob shaft 50*b* and the lever 214*b*, which is used only Fail-Secure assemblies, not needed with Fail-Safe assemblies.

A cosmetic cover plate 212 in FIG. 21 is used to hide the holes, and the screw heads in the closed top 85*b* of housing 12 after a lock is installed for use. Where a lock is assembled for Fail-Safe use, the hole 6 is not included in cover 212, for here cover 212 also hides hole 5 of housing 12 cosmetically. But for Fail-Secure use of the hole 6 in cover 212 is implemented to make clearance for knob shaft 50*b* used with knob 126 and lever 214*a*.

Figure 12:
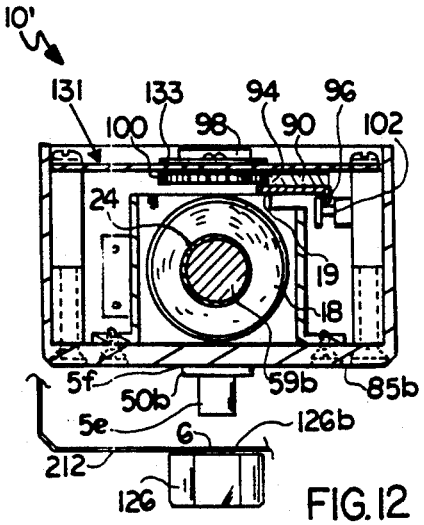
FIG. 12 is a view showing the alternate embodiment with the bolt assembly advanced.

FIG. 12 shows cosmetic cover 212 going over installed lock 10''. Then knob 126 is in line for installation.

Figure 13:
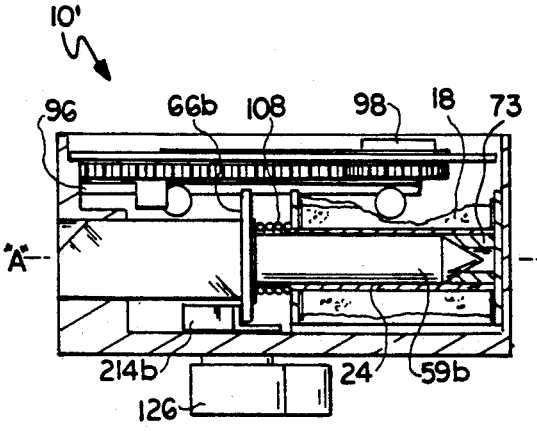
FIG. 13 is a view showing the alternate embodiment with the bolt assembly retracted, by the front knob and lever assembly.

FIG. 13 shows all said parts assembled together, retracting bolt assembly 28*b*.

Housing 12 and u shaped cover 212 are attached here by using screws 212*a*, holes 212*b*, and threaded holes 212*c* in FIG. 21.

The adjustable backset plate assembly 86, as shown in FIGS. 9 through 18, is composed of a bushing 98 and a rectangular backset slide plate 133 which contains a cylindrical bearing hole 133*b* to receive the bushing 98 on one side along the center line of the longer length.

A small distance from the axis "A", in the backset slide plate 133, runs a thin slot 133*a*. The slot 133*a* extends almost to the end of the backset slide plate 133. On the center line of the backset plate 131, running lengthwise to almost one end, is a rectangular opening 86*a* which is slightly smaller than the rectangular slide plate 133.

At the sides of the opening 86*a*, running parallel to the center line "A" are two tracks 86*b* which mate with tracks 86*c* of a square slide 132 for controlling the sliding action thereon. A threaded hole 140*a*, disposed in the adjustable backset plate 131 and parallel with the center line "A", controls the movement of the rectangular slide 133 along the center line "A" when joined with a screw 140. The screw 140 is tightened so that it may securely fasten the rectangular slide 133 in the desired position.

The bushing 98 which receives part 101*a* of key cylinder 101 into the bushing opening 98*d*, has a cylindrical stem 98*c* which is centered on the axis A'. The bushing stem 98*c* in turn enters through the bearing hole 133*b* of the slide plate 133 and is journaled there at a "T"-end or shoulder 98*b*. The other end 98*c* extends through the rectangular opening 86*a* of the adjustable backset plate assembly 86 and enters through a bearing hole 132*a* of the square slide 132. The bushing stem 98*c* in turn is fitted on the other side of the plates 133, 131, and 132*a* and fixably fastened into the hole 211*z* of an actuation element cam lever 211 or the hole 100*z* of on the spur gear 100. The cam lever 211 has an eccentric actuating tab 211*a* extending parallel to but offset from the axis A'.

The assembled adjustable backset plate 86 is screwed into the lock 10' using two appropriate symmetrically placed mounting holes 144*a* with the screws 144 and the threaded holes 144*b* of housing 12 in relative position, as shown in FIGS. 9 and 11. When the slide plate 133 and the bushing 98 with lever 211 or with spur gear 100 is set closer to the bolt 80*b* of bolt assembly 28*b* and the crosspiece 66*b* front end of the lock 10', it is then set for the smaller lock backset settings, as shown in FIG. 11.

The slide plate 133 and the bushing 98 in the first group of settings can be set further back and away from the bolt 80*b* of bolt assembly 28*b* and the crosspiece 66*b* from the front area end of the lock for larger measurement backset settings, as shown in FIGS. 11, 14, 17, and 24, for the first half of the back setting span.

For the still larger backset settings the backset plate assembly 86 is unattached and is turned 180° and set back in with the screws 144 in a facing position, as shown in FIGS. 13, 15, 16, and 18, for the still larger backset settings in the second half of the back setting span.

When a key is turned in the key cylinder 101 mounted to be used from the outside of a door, it in turn, turns bushing 98 and then the attached spur-gear 100 (or lever 211). When the bushing 98 is attached to spur-gear 100 from what ever backset it is set to, that is, from close to the front of the lock 10' to close to the back of the lock 10' according to the type of door it must serve, the teeth portion 100*a* of the spur-gear 100 mesh with the teeth portion 94 of the rack gear bridge 90, it can be activated from any backset setting from the smallest to the largest.

The rack gear bridge 90 is attached to the rack gear base 92 which has a "L" shape cross section and is movably situated and also guided to ride from front to back, back and forth there-in in the direction of "A" between the inner side 104 of the adjustable backset plate assembly 86 and the portion area 19 of the solenoid assembly 18. The track portion 96 rides in the groove guide points 102, as seen in FIG. 12. Another alternative part of this present invention is the adjustable slotted backset plate assembly 86*k*, shown in FIGS. 22 and 24, the connections from the bushing 98 to the spurgear 100 are the same.

The rectangular slide 133*k* has two slots 133*a* and two screws 140 and two threaded holes 140*k* in plate 131*k*. The plate 131*k* also has four enter holes 960 to 963 with extending side slots 960*a* to 963*a*.

Figures 22, 23:
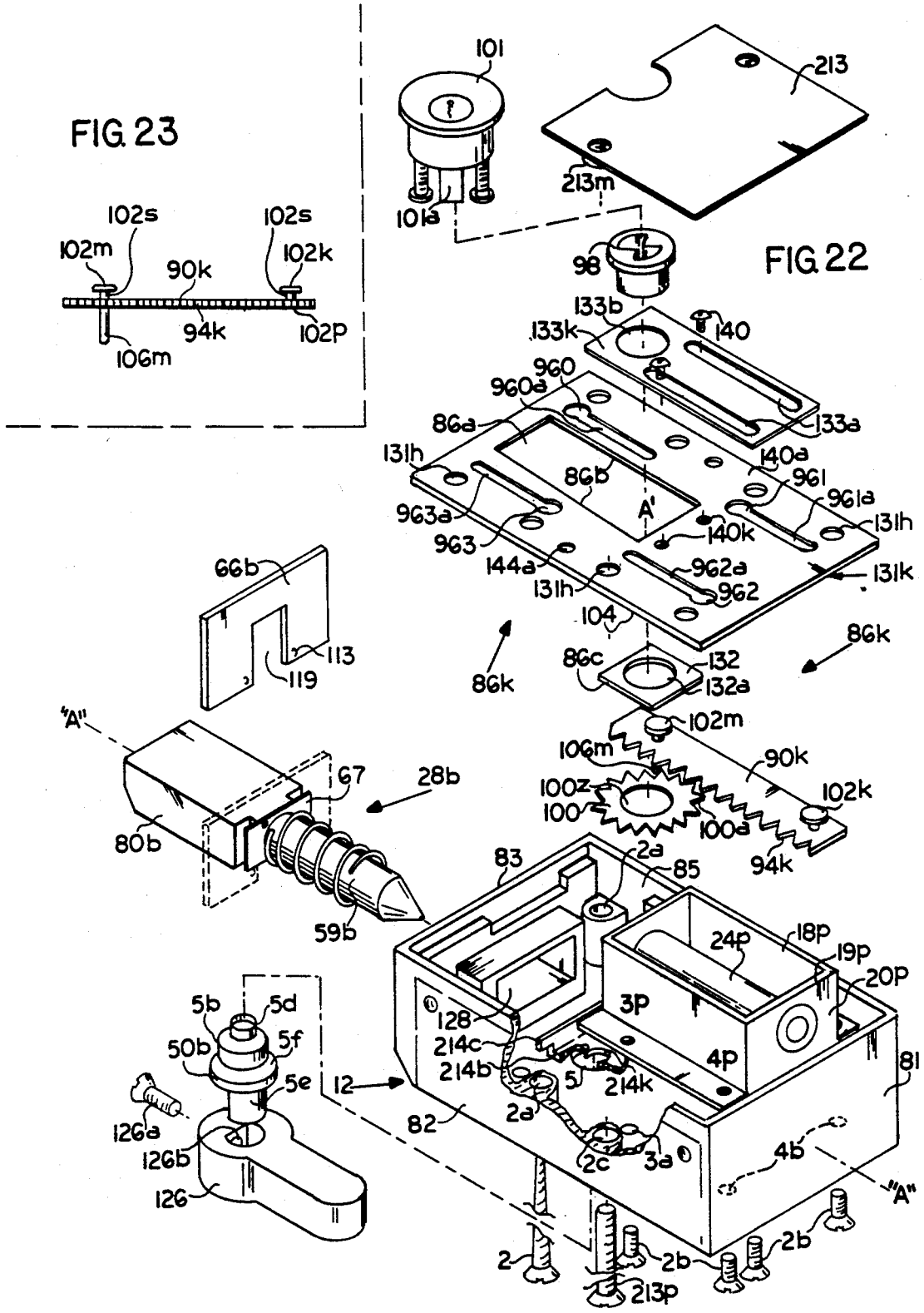
FIG. 22 is an exploded perspective view of alternate assembly embodiments of the invention shown in FIGS. 1 and 9.
FIG. 23 is a view of an alternate rack gear bridge.

The rack gear bridge 90*k* as also seen in FIG. 23 has a head-pin 102*m* fixably inserted with clearance 102*s* to clear the thickness of plate 131*k* at the top area of bridge 90*k* with a stem 106*m*, extending through the bottom area. Headpin 102*k* is fixably inserted with clearance 102*s* at the top area of bridge 90*k* and at the bottom area having no stem.

Figure 24:
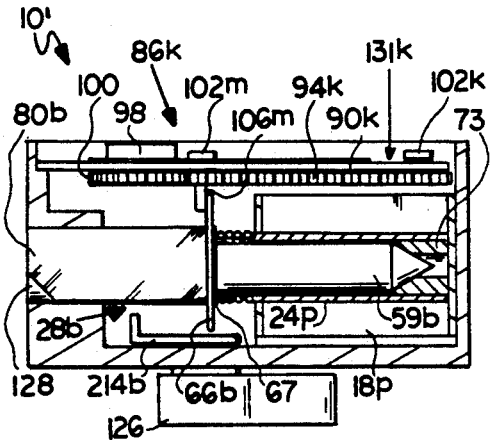
FIG. 24 is a view of an alternate assembly embodiment of the invention.
Figure 16:
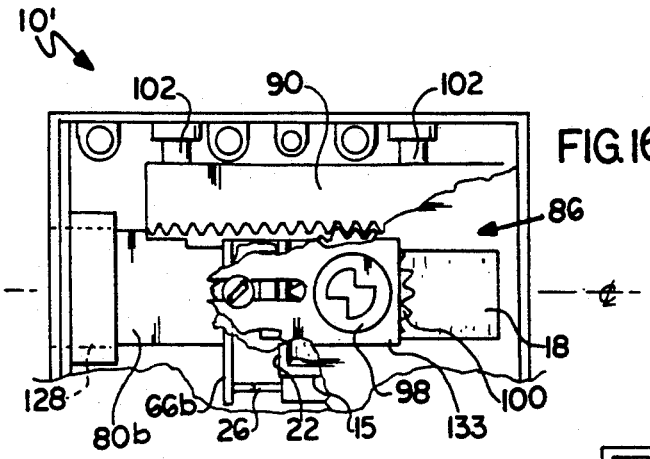
FIG. 16 is a plan view with the bolt assembly retracted and the adjustable backset in one position.
Figure 17:
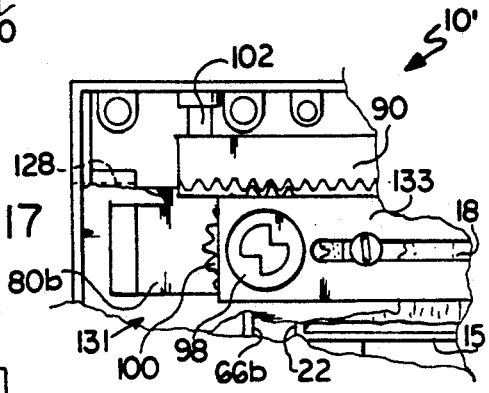
FIG. 17 is a plan view with the bolt assembly retracted and the adjustable backset in another position.
Figure 18:
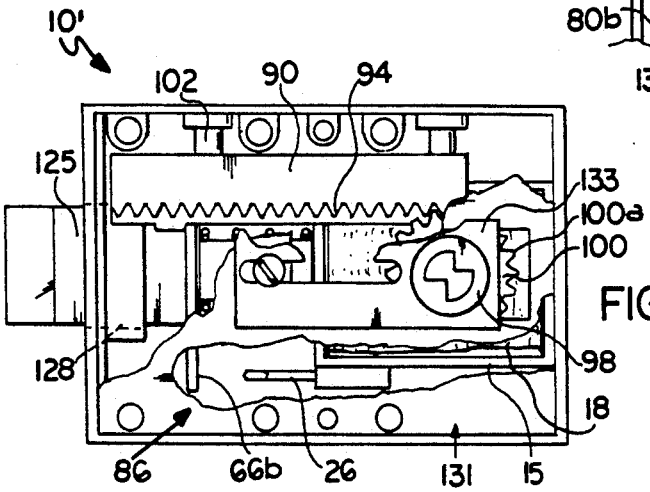
FIG. 18 is a plan view showing internal parts when bolt assembly is advanced.

For the smaller backset settings, headpin 102*m* is past through enter hole 960 and headpin 102*k* is past through enter hole 961 from the inner side 104 of plate 131*k*. Now there with this rack gear bridge 90*k* in movable contact with inner plate side 104 surface and rack gear teeth 94*k*, meshing with spur gearteeth 100*a* and with the extending slide slots 960*a* and 961*a* receiving clearance area 102*s* of headpin 102*m* and 102*k*. Then with said headpin movably mounted in contact with the outer plate side 104*a* surface, the rack gear 90*k* as seen in FIG. 24, can move so guided from front to back, back and forth therein, in the direction of "A".

Interchangeable with adjustable backset plate assembly 86, this adjustable slotted backset plate assembly 86*k*, is installed so that the extending stem 106*m* of rack gear 90*k*, makes contact with crosspiece 66*b* activate bolt assembly 28*b*, for the smaller backset settings. For the larger backset settings the interchangeable adjustable backset assembly plate 86*k* is turned 180°, the rack gear bridge 90*k* is set so that the headpin 102*m* utilizes enter hole 962 and slot 962*a* of adjustable backset plate 86*k* and the headpin 102*k* utilizes enter hole 963 and slot 963*a*, with following the related just before, stated operational procedure.

Figure 14:
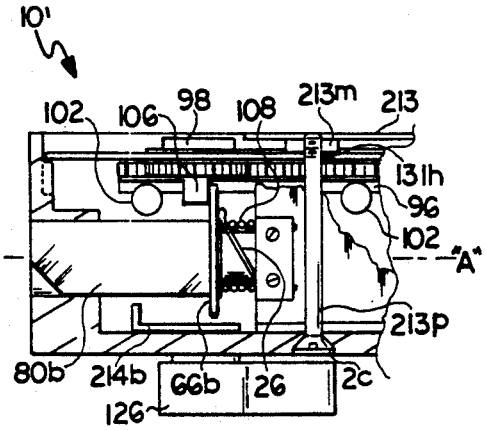
FIG. 14 is a view showing the alternate embodiment with the bolt assembly retracted and reversed.
Figure 19:
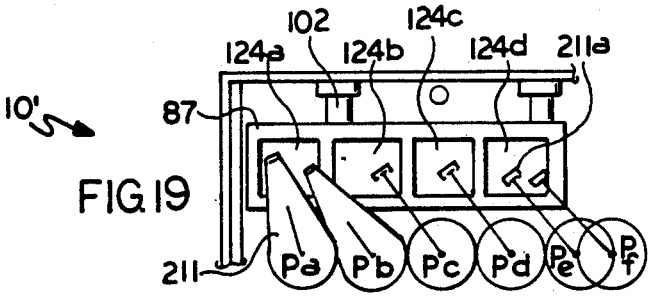
FIG. 19 is a plan view showing another alternate embodiment.
Figure 20:
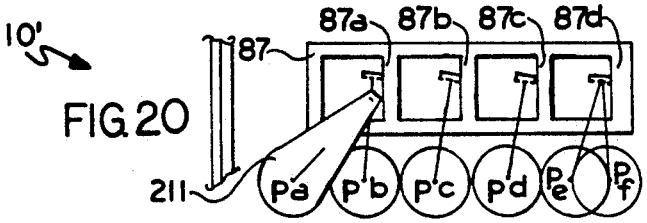
FIG. 20 is a plan view showing another alternate embodiment.

When the bushing 98 is attached to lever 211, the lever 211 will ride over the bridge 87. The bridge 87 is guided as is with bridge 90, its track portion 96*a*, riding in groove guides 102. The lever tab 211*a* is put into the appropriate selected opening 124*a, b, c*, or *d*, 124*a* for smallest backset position, 124*d* for longest as shown in FIGS. 19 (lock 10' being in locked position) and 20 (lock 10' being put into unlocked position). When the lever 211 is swiveled, from either selected backset position Pa, Pb, Pc, Pd, Pe or Pf, position Pa being for the smallest backset position and Pf for the largest the lever tab 211*a* butts up against a slat 87*a, b, c*, or *d*, slat 87*a* for the smallest backset and slat 87*d* for the largest and forces the bridge 87 backward. As is also the case when the bushing 98 is attached to spur-gear 100 and moves the rack gear bridge 90. The bridge tab 106 or 106*a* butts up against the crosspiece 66*b* in order to move the bolt assembly 28*b* backwards against the tension of spring 108 (as seen in FIG. 14) within the lock and therefore putting the lock into the unlocked position so door can be opened.

Figure 15:
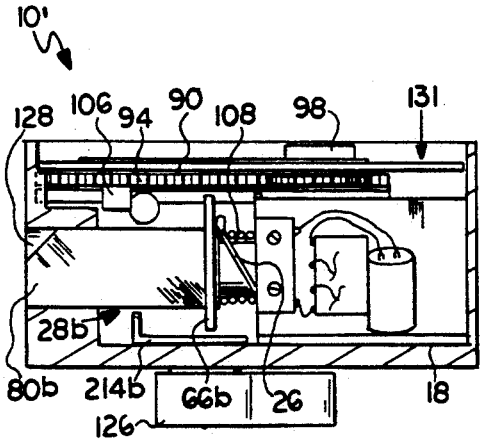
FIG. 15 is a view showing the alternate embodiment with the bolt assembly retracted to activate the current reduction switch.

FIG. 15 shows where the bolt assembly 28*b* is pulled in electronically at full power of the solenoid assembly 18, putting the improved lock 10' in an open position against pressure of the spring 108. This causes the crosspiece 66*b* to encounter and activate the electrical lever switch 26, which reduces or cuts down power of the solenoid assembly 18. This avoids overheating of the solenoid assembly 18 when it is desired to still hold the bolt assembly 28*b* in for long periods of time with the electric current on.

When all the electric power to the lock's electric mechanism is turned off, the spring 108 pushes the bolt assembly 28*b* out as seen in FIG. 11.

Seen in FIG. 10, the crosspiece 66*b* is removable, so that the bolt assembly 28*b* can be removed from the improved lock 10' through the bolt guide opening 128, and so that the beveled side 125 of the bolt assembly 28*b* can be reversed on axis "A", 180° to facilitate its use on either, in or out swing door operations.

The case 18*p* with anvil 73 and tube 24*p* seen in FIGS. 22 and 24 interchanges with solenoid 18 of FIGS. 9 to 18 for the lock 10' to be made or produced cost effective without the electric wiring where only the mechanical advantages of this lock 10' is needed. As seen in FIG. 22 and FIG. 24 the case 18*p* with anvil 73 and tube 24*p* is fastened into the housing 12 utilizing screws 2*b* in holes 3*a* and 4*b* and holes 3*p* and 4*p* therein. And in FIG. 24 it is seen in its working assembly.

With narrow stile installations of lock 10', as only the front four mounting holes 2*a* seen in FIG. 21 are used, mounting holes 2*c* together with machine screws 213*p* seen in FIGS. 22 and 14, can be used to attach the back shield plate 213*k* via its affixed threaded spacer bushings 213*m* to the rear back of the lock 10' to shield this area where housing 12 extends past the narrow stile.

We claim:

1. A lock assembly interchangeable for selectively assembling or producing an electronic Fail-Safe or Fail-Secure and or mechanically operated slam latch lock for mounting on the rim of a narrow stile or large stile door comprising:

a) a housing having four sides, one side having a bolt opening and a closed top side having solenoid mounting holes, multiple door installation mounting holes, and a knob hole, and said housing defining an open area for receipt of a flat plate cover for Fail-Safe lock assemblies or adjustable settings backset plate assemblies for Fail-Secure and Mechanical lock assemblies;

b) a solenoid having mounting holes disposed within said housing including an anvil fixably mounted within said solenoid assembly having mounting holes, an electrical lever switch, an electrical coil with a tubular central core hole having an anvil side and a plunge in side, said anvil having a central throughbore running along an axis of said solenoid and said anvil being fixably mounted at the anvil side within said solenoid coil core hole and with a first plunger also having a central throughbore running along the axis of said solenoid and said first plunger being movably mounted within said solenoid core hole, the said anvil side facing the said bolt opening side of said housing, the said mounting holes of the said solenoid matched up with some of said mounting holes of said housing;

c) said first plunger having an outer plunger spring and a first crosspiece being fixably attached to an outer end of the said first plunger, said first plunger being movably mounted within said solenoid between locked and open position for Fail-Safe use;

d) a first bolt assembly within said lock movable between locked and open position and having a first bolt, said assembly comprising a shaft extending from said bolt being removably and movably mounted within said lock with said bolt extending forward through said bolt opening of said housing, the extending shaft passing through said bolt opening of said housing, the extending shaft passing through said central throughbores of said plunger and said anvil, said extending shaft having a free end that contains a groove extending through the outer end of said first plunger to receive a mountable means to hold and control the movement of said first bolt, said first bolt being substantially ramp shaped to aid said bolt assembly to retract to slam latch lock when said lock is operated on a door and encounters a strike on a door frame while said solenoid is energized holding said lock in the locked position electronically with said anvil and said plunger in magnetic contact and said first crosspiece pressing on said electrical lever switch of said solenoid to reduce current flow to permit said solenoid to remain cool, said shaft having a wide portion and a narrow portion, said narrow portion having a second spring disposed thereon, said second spring on said shaft urging said bolt assembly outwardly to the locked position while said spring on said first plunger urges said first plunger inward to the open position so that said bolt assembly and said plunger may move in opposite directions along said axis from front to back of said solenoid Fail-Safe latch lock;

e) said mountable means is for removably mounting said first bolt assembly from within said plunger and anvil at said free end of said shaft so that said bolt assembly can be pulled out and replaced or rotated to fit inswing and outswing applications on a door rim;

f) a second bolt assembly for a Fail-Secure lock assembly being interchangeable with said first bolt assembly and having a second bolt, a clamp plate, a second plunger having a spring for urging said second bolt assembly to a locked position disposed thereon and space between said second bolt and said clamp plate for a removably mounted second crosspiece, said second bolt being substantially ramp shaped to cause the lock to latch lock when a door is swing slammed closed, means securing said second bolt and said clamp plate to said second plunger and being removably mounted with said second plunger within said solenoid and lock, after said solenoid being set into the said housing with only the said affixed anvil within said solenoid coil core hole, said mounting holes of said solenoid being set together with some of said mounting holes in said housing used for reversing said solenoid so that the lock can be changed from a Fail-Safe lock to a Fail-Secure lock, said solenoid being mounted in said housing with said plunge in side of said solenoid facing said bolt opening side of said housing for Fail-Secure use, said housing being provided with a knob and lever utilized with said knob hole in said housing; and g) said second bolt assembly being removably mounted within said solenoid and lock so that said second bolt assembly can be rotated to fit inswing and outswing applications on a door rim, said second bolt assembly entering the said lock housing through the said bolt opening of said housing lead by a front end of said second plunger, said second plunger entering said core hole of said solenoid from said plunge in side and said second plunger slidable within said core hole of said solenoid and said second bolt of said second bolt assembly being slidable within the bolt opening of said housing.

2. The lock assembly as defined in claim 1, wherein second bolt assembly includes said removably mounted second crosspiece to limit forward travel of said second bolt assembly, one end of said second crosspiece encountering said knob lever to bring said second bolt assembly inward when said knob is manually turned to bring said lock to an unlocked position, and the other end of said second crosspiece encountering said adjustable backset plate assemblies to bring said bolt assembly inward, when a connecting key cylinder set in at either a large or a small backset setting is turned manually from outside of said door to bring said lock to an unlocked position, said second crosspiece within said second bolt assembly being the means to activate the electrical lever switch decreasing current to said solenoid when said lock is to be kept in an unlocked position by said solenoid.

3. A lock assembly as defined in claim 2, wherein an all mechanical lock utilizes said adjustable backset plate assemblies with a bridge, adjustable to be set at a variety of backset settings, to operate with a key cylinder set at various backset settings on narrow to large stile doors.

4. The lock assembly as defined in claim 1, wherein said first bolt assembly comprising said bolt and shaft is made from nonmagnetic material.

5. The lock assembly as defined in claim 1 in which said anvil and said plungers are made from magnetic material.

6. The lock assembly as defined in claim 1, wherein said anvil and said plungers have complementary surfaces that make magnetic contact within said solenoid when said solenoid is electrically energized.

7. The lock assembly as defined in claim 1, further comprising a clip, removably mounted to said groove of said shaft, free end, which limits outward movement of said first bolt assembly while said clip is mounted and for releasing said first bolt assembly when said clip is removed.

8. The lock assembly as defined in claim 1, wherein said first bolt and said second bolt each has a ramped and, flat sufficient surface engaged in a strike, so that each of said first bolt and said second bolt can not be forced back by a plastic card or the like.

9. A lock assembly as defined in claim 1, further comprising a second crosspiece containing means for removably mounting said crosspiece from said second bolt assembly so that said second bolt assembly can be released and reversed to accomodate applications on inswinging and outswinging doors.

10. The lock assembly according to claim 1, wherein said housing additionally includes interchangeable adjustable backset plate assemblies and has a cosmetic front cover plate and a cosmetic back cover plate.

11. The lock assembly according to claim 10, additionally including means for adjustably setting said backset plate assemblies to operate from a key cylinder set at various different backset settings on a door so that said backset plate assemblies can be adjustably set in place between a small and a large backset setting.

12. The lock assembly according to claim 11, wherein said means for adjustably setting said backset plate assemblies includes rack and gear bridge assemblies.

13. A lock assembly for use on the stile of a door mounted in a doorway having a strike, said lock assembly being adaptable to stiles of a wide range of widths, comprising:

a) a housing mounted on said stile having a bolt opening facing said strike on said doorway;

b) solenoid means within said housing for electrically actuating said lock assembly;

c) said solenoid means provided with a central core passageway in which at one end an anvil of magnetic material is affixed and through the other end a slidable plunger of magnetic material is mounted, said anvil and plunger having an axially extending opening therethrough;

d) first spring means for biasing said plunger in the direction away from said striker and unlocking said lock assembly;

e) a bolt assembly comprising a bolt having a shaft extending therefrom into said central core passageway of said solenoid means and the axially extending opening of said anvil and plunger movably secured with a removably mounted clip means;

f) said shaft being provided with second spring means for biasing said shaft with respect to said plunger in the direction toward said striker and locking said lock assembly;

g) said bolt being positioned within said housing opening on one side of said solenoid means when said lock assembly is in its unlocked position;

h) said solenoid means having a trigger switch located on the other side of said solenoid means;

i) said anvil of magnetic material facing said bolt opening and located within the central core passageway of said solenoid means adjacent said one side of said solenoid means;

j) said anvil being shaped to receive a facing end of said plunger;

k) means mounted on the end of said plunger at the other side of said solenoid means capable of contacting and actuating said trigger switch when said solenoid means is actuated causing said plunger to move toward said striker on said doorway, making contact with said anvil, and causing said bolt assembly to be moved until said bolt engages said striker thereby locking said door;

l) said trigger switch upon actuation reducing current flow to said solenoid means to a value just sufficient to maintain said bolt in the lock position in order to reduce heating in said solenoid means; and m) said second spring means permitting said bolt assembly to be moved with respect to said plunger in order to permit said door to be opened or closed when said solenoid means is energized.

14. A lock as defined in claim 13, wherein said housing is a symmetrical open box with means for mounting said housing securely on narrow to large stile doors, and having a removable flat back plate over open part and having a removable cosmetic front plate.

15. A lock as defined in claim 13, wherein said bolt and shaft are made from nonmagnetic material.

16. The lock assembly as described in claim 13 in which said bolt has one surface forming a ramp to permit said door to be slammed shut, said bolt being retracted in toward said housing and the shaft of said bolt being retracted through the said anvil and plunger opening when said ramp contacts said strike without retracting said plunger in magnetic contact with said anvil.

17. The lock assembly as described in claim 16, wherein said means for removably mounting said bolt assembly allows said bolt assembly to be completely removable from said housing without dismantling said lock assembly to reverse the orientation of said bolt assembly thereby being able to accommodate both an inswinging and an outswinging door.

* * * * *